US007527423B2

(12) United States Patent
Ruchonnet et al.

(10) Patent No.: US 7,527,423 B2
(45) **Date of Patent: *May 5, 2009**

(54) WATCH COMPRISING TWO TOURBILLONS

(75) Inventors: Jean-François Ruchonnet, Mont-sur Rolle (CH); Alain Zaugg, Le Brassus (CH)

(73) Assignee: Montres Breguet SA, L'Abbaye (CH)

( * ) Notice: Subject to any disclaimer, the term of this patent is extended or adjusted under 35 U.S.C. 154(b) by 174 days.

This patent is subject to a terminal disclaimer.

(21) Appl. No.: 10/599,974

(22) PCT Filed: Apr. 13, 2005

(86) PCT No.: PCT/EP2005/003892

§ 371 (c)(1),
(2), (4) Date: Oct. 16, 2006

(87) PCT Pub. No.: WO2005/111742

PCT Pub. Date: Nov. 24, 2005

(65) Prior Publication Data

US 2008/0144447 A1 Jun. 19, 2008

(30) Foreign Application Priority Data

Apr. 15, 2004 (CH) ..... 0643/04

(51) Int. Cl.
*G04B 15/00* (2006.01)
*G04B 19/20* (2006.01)

(52) U.S. Cl. ..... 368/127; 368/140

(58) Field of Classification Search ..... None
See application file for complete search history.

(56) References Cited

U.S. PATENT DOCUMENTS

| | | | | |
|---|---|---|---|---|
| 5,838,641 | A * | 11/1998 | Tohkoku et al. | 368/127 |
| 6,890,094 | B2 * | 5/2005 | Dias | 368/127 |
| 7,004,619 | B2 * | 2/2006 | Papi | 368/127 |
| 7,160,026 | B2 * | 1/2007 | Golay | 368/127 |
| 2005/0007888 | A1 | 1/2005 | Jolidon | |
| 2005/0201209 | A1 | 9/2005 | Golay | |
| 2006/0187760 | A1 * | 8/2006 | Kasapi | 368/127 |

FOREIGN PATENT DOCUMENTS

| | | |
|---|---|---|
| CH | 30754-568 | * 11/1905 |
| CH | 156801 | * 5/1931 |

(Continued)

OTHER PUBLICATIONS

Search Report issued by the Australian Patent Office in corresponding application No. SG 200601948-3, completed Jul. 12, 2006 and mailed Jul. 20, 2006.

(Continued)

*Primary Examiner*—Vit W Miska
(74) *Attorney, Agent, or Firm*—Griffin & Szipl, P.C.

(57) ABSTRACT

In order to improve the isochronisms of the mechanical movement of a watch, the regulating members comprise at least two tourbillions mounted on a common rotating support driven by one or several barrel springs, such that the tourbillions make an orbital movement around the axis of rotation of the support. The tourbillions are connected by respective going trains to a differential gear, one of whose elements is immobilised by friction.

9 Claims, 4 Drawing Sheets

FOREIGN PATENT DOCUMENTS

| | | | | |
|---|---|---|---|---|
| CH | 256590 | | | 3/1949 |
| CH | 262017 | | * | 9/1949 |
| CH | 693 832 | | | 2/2004 |
| CH | 695 196 | A5 | | 1/2006 |
| EP | 0 846 987 | | | 6/1998 |
| EP | 1 408 381 | A1 | | 4/2004 |
| EP | 1 465 024 | A1 | | 10/2004 |
| FR | 2 784 203 | | | 4/2000 |
| GB | 2 027 232 | | | 2/1980 |
| GB | 2 375 619 | A | | 11/2002 |
| WO | 03/017009 | A2 | | 2/2003 |
| WO | 2004/077171 | A2 | | 9/2004 |
| WO | 2005/097533 | A2 | | 11/2004 |
| WO | 2005/043257 | A1 | | 5/2005 |

OTHER PUBLICATIONS

Search Report issued by the Danish Patent Office in corresponding application No. SG 200601948-3, completed Sep. 13, 2006.

Hanke, Marcus, "If you thought you had seen it all: Th. Prescher's Double Triple-Axis Tourbillon concept," AHCI Discussion Board, http://www.network54.com/Forum/message?forumid=125316 &messageid=1110757723, printed Jun. 20, 2005.

Prescher, Thomas, "Triple Axis Tourbillon with constant force," http://www.p178host.com/ahcigallery/Prescher_tat/ prescher_tat_e5.html, printed Jun. 20, 2006.

International Search Report issued in corresponding application No. PCT/EP2005/003892, completed Jun. 27, 2005 and mailed Jul. 5, 2005.

Meis, R., "Le Tourbillon," ISBN 2-85917-097-9, Editions de l'Amateur, Paris, 1990, pp. 75-77.

* cited by examiner

WATCH COMPRISING TWO TOURBILLONS

This is a National Phase Application in the United States of International Patent Application No. PCT/EP2005/003892 filed Apr. 13, 2005, which claims priority on Swiss Patent Application No. 00643/04, filed Apr. 15, 2004. The entire disclosures of the above patent applications are hereby incorporated by reference.

BACKGROUND OF THE INVENTION

The present invention concerns a watch with a mechanical movement and it relates to the reduction of rate variations which result from the effects of gravity on the regulating members of the watch, because of inevitable faults in the poising of such members, and because of the variation of these effects in the various positions that the user imposes on his or her watch.

The tourbillon invented two centuries ago by Abraham-Louis Breguet is a device that causes such a reduction. As the oscillator and the escapement are mounted in a carriage that rotates about an axis parallel to the axis of the sprung balance assembly, the gravity component that is exerted in the plane perpendicular to these axes performs a continuous rotation in relation to the members, such that each rotation of the carriage leads to a compensation of the effects of any disequilibrium in that plane and thus improves the regularity of rate of the watch when it is worn, especially when the watch is in a vertical or inclined position. In order to simplify the terminology, the term "tourbillon" is used here to designate both devices in which the balance axis coincides with the axis of rotation of the carriage (for example in accordance with Breguet or in accordance with CH Patent No. 262 017) and the devices that are often called "carrousels", when such axes are distinct (see for example CH Patent Nos. 30 754, 256 590 and EP Patent No. 846 987).

Given that a conventional tourbillon does not compensate perfectly for the effects of gravity, watchmakers looking to further improve the isochronism of high quality mechanical watches have devised tourbillons with two or three axes of rotation perpendicular to each other, disclosed in particular in Patent Nos. GB 2 027 232, CH 693 832, EP 1 465 024 and WO 2004/077171. These designs constitute remarkable technical prowess, but they occupy a spherical space and thus can only be placed in an extremely thick watch.

According to WO Patent No. 03/017009, a similar object is achieved by means of a tourbillon with two axes of rotation which intersect at an angle other than 90°, for example at 30°. This design is more compact in height than that with two perpendicular axes, but it remains considerably thicker than a conventional tourbillon movement.

FR Patent No. 2 784 203 presents yet another manner of reinforcing the compensation produced by the tourbillon. The tourbillon, the barrel that drives it and the gear train connecting these two elements are all mounted on a rotating plate completing one revolution per hour, whose axis of rotation is parallel to that of the tourbillon. This arrangement forms, in a way, a tourbillon on a carrousel, with the tourbillon completing revolutions about the centre of the rotating plate.

Another idea, consisting in coupling two regulating members mounted on the plate of a watch movement in order to average their rate by means of a differential gear, was formulated in the 1930s by Mr. Vuilleumier and published in CH Patent No. 156 801, but this concerned only the usual stationary regulating systems (sprung balance and escapement). An improvement consisting in mounting such an assembly on a rotating plate is disclosed in the work of R. Meis "Le Tourbillon", ISBN 2-85917-097-9, Editions de l'Amateur, Paris, 1990, p. 75-77, but it remains at the model stage, and has not been able to be integrated into a watch.

SUMMARY OF THE INVENTION

The basic idea of the present invention consists in reducing the variations in rate of a tourbillon watch in a manner different from the aforementioned methods and in particular avoiding an excessive thickness of the movement and thus of the watch. It is an additional object to create a watch having an original appearance, emphasizing the highly technical nature of the movement.

In its most general aspect, the invention concerns a watch with a mechanical movement comprising two tourbillons that are mounted on a common rotating support and coupled via gear trains to the same median element, the rotating support being driven by a mechanical power source and connected to an analogue time display device. Preferably, said median element is formed by a differential gear, able to be centred on the axis of rotation of the rotating support, but other modes of coupling the two tourbillons can be envisaged.

Thus, instead of aiming to compensate for disequilibria in planes other than the general plane of the watch, the present invention reduces variations in rate by using a time base whose frequency is the mean of those of the two tourbillons mounted on a common support. The fact that the common support bearing the two tourbillons is a rotating plate adds to the compensatory effects provided in FR Patent No. 2 784 203 in order to further improve the rate regularity of the watch. The axes of the two tourbillons can be parallel and the two balances can be in the same plane, such that the thickness of the movement may be comparable to that of a conventional tourbillon movement. However, one could also envisage applying the principle of the invention to make a movement comprising two tourbillons whose balances are each inclined by a small angle in relation to the general plane of the watch, but in opposite directions in order to form between them a total angle sufficient to compensate better for disequilibria in different planes, without considerably increasing the total height of the movement.

BRIEF DESCRIPTION OF THE DRAWINGS

Other features and advantages of the present invention will appear from the following description, which presents a preferred embodiment by way of non-limiting example with reference to the annexed drawings, in which.

DETAILED DESCRIPTION OF A PREFERRED EMBODIMENT

Figure 1:
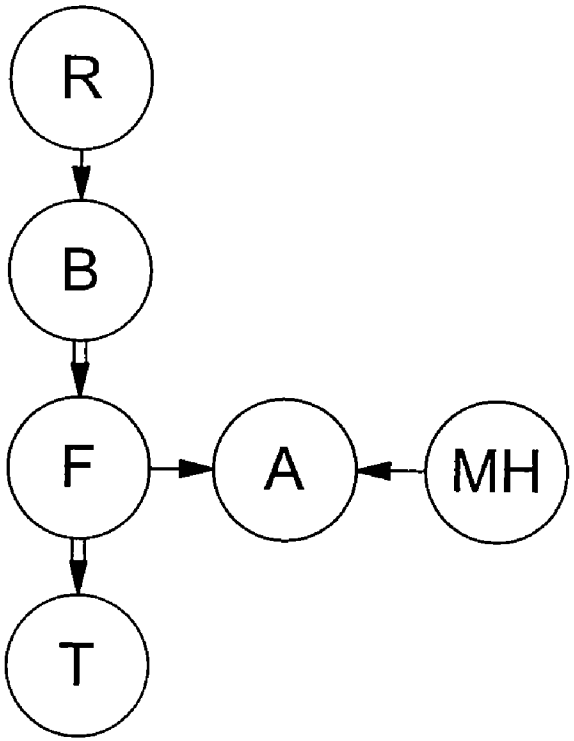
FIG. 1 is a flow chart of a conventional tourbillon watch movement.

For better comprehension of the operation of the examples described hereinafter, the flow charts of FIGS. 1 and 2 respectively show a conventional tourbillon watch movement and the preferred embodiment of a watch with two tourbillons according to the invention. Reference will be made to the following legend:

| | |
|---|---|
| A | Display |
| B, B1, B2 | Barrel |
| D | Differential gear |
| F | Going train |
| MH | Time-setting |
| T, T1, T2 | Tourbillon |
| R | Winding |

In these diagrams, the single arrows represent gear trains without any transmission of energy to the oscillators, whereas the double arrows represent gear trains with energy transmission to the oscillators. It will also be noted that in the diagram of FIG. 1, which is well known to watchmakers, the symbol T can equally represent a tourbillon or an ordinary mechanical oscillator, and also that in a well known variant, display A can be derived directly from barrel B rather than from going train F.

Figure 2:
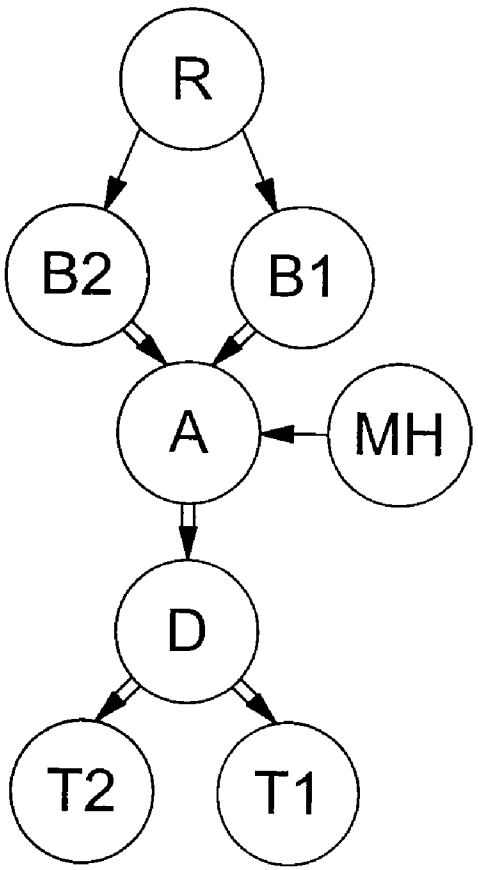
FIG. 2 is a flow chart of a watch movement with two tourbillons.

With the diagram of FIG. 2, the energy necessary for the regulating system comprising two tourbillons is supplied by two barrels B1 and B2 working in parallel, but one could also envisage using barrels coupled in series or a single barrel of large size. The energy passes through a display train A and a differential gear D which distributes it between two tourbillons T1 and T2. If the two tourbillons do not have exactly the same frequency at a given moment, their respective speeds of rotation are averaged by differential gear D, such that display A rotates at a stabilised speed via compensation of the rate variations of one tourbillon in relation to the other.

Figure 3:
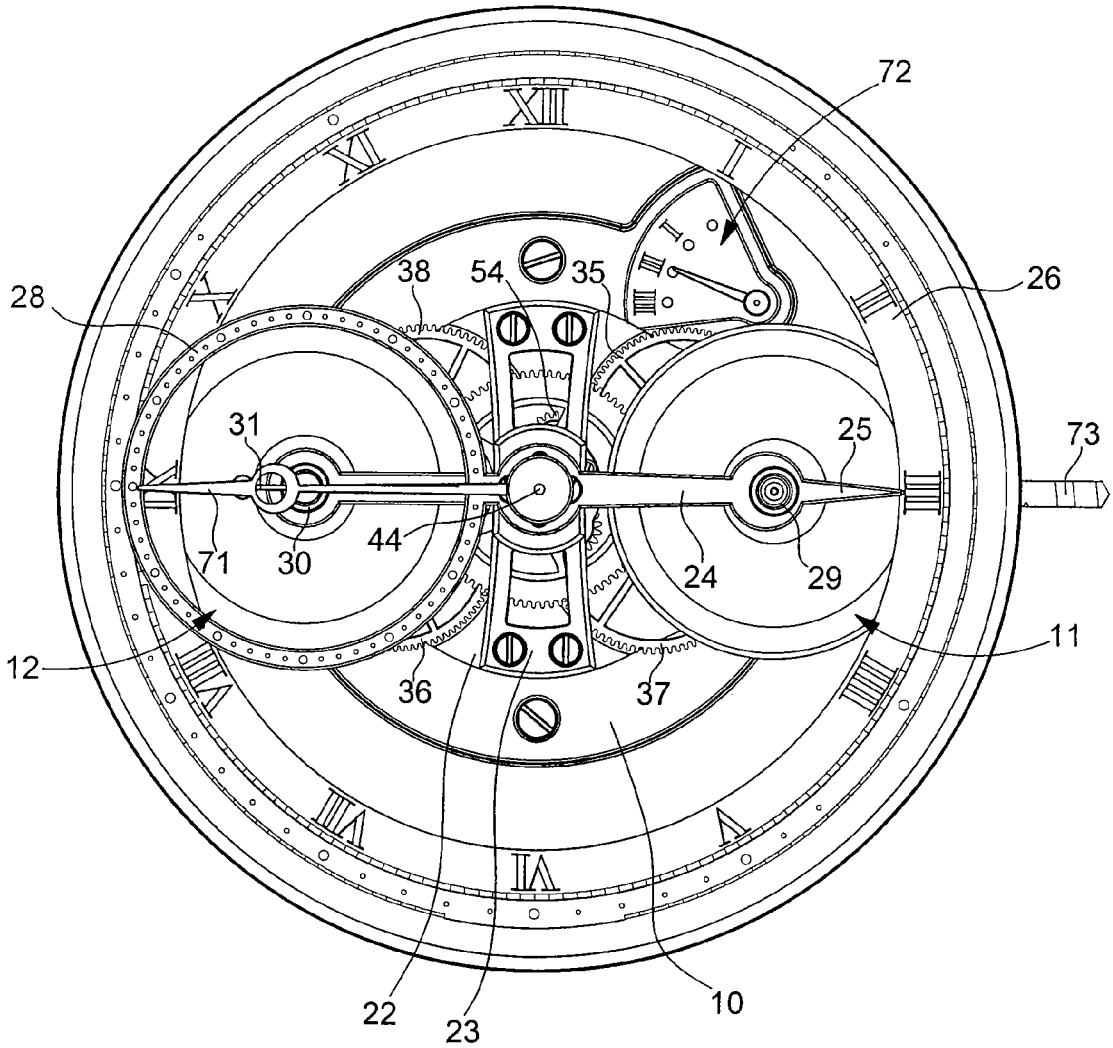
FIG. 3 is a schematic plan view of the movement and dial of a watch according to the diagram of FIG. 2, comprising two tourbillons on a rotating support.
Figure 4:
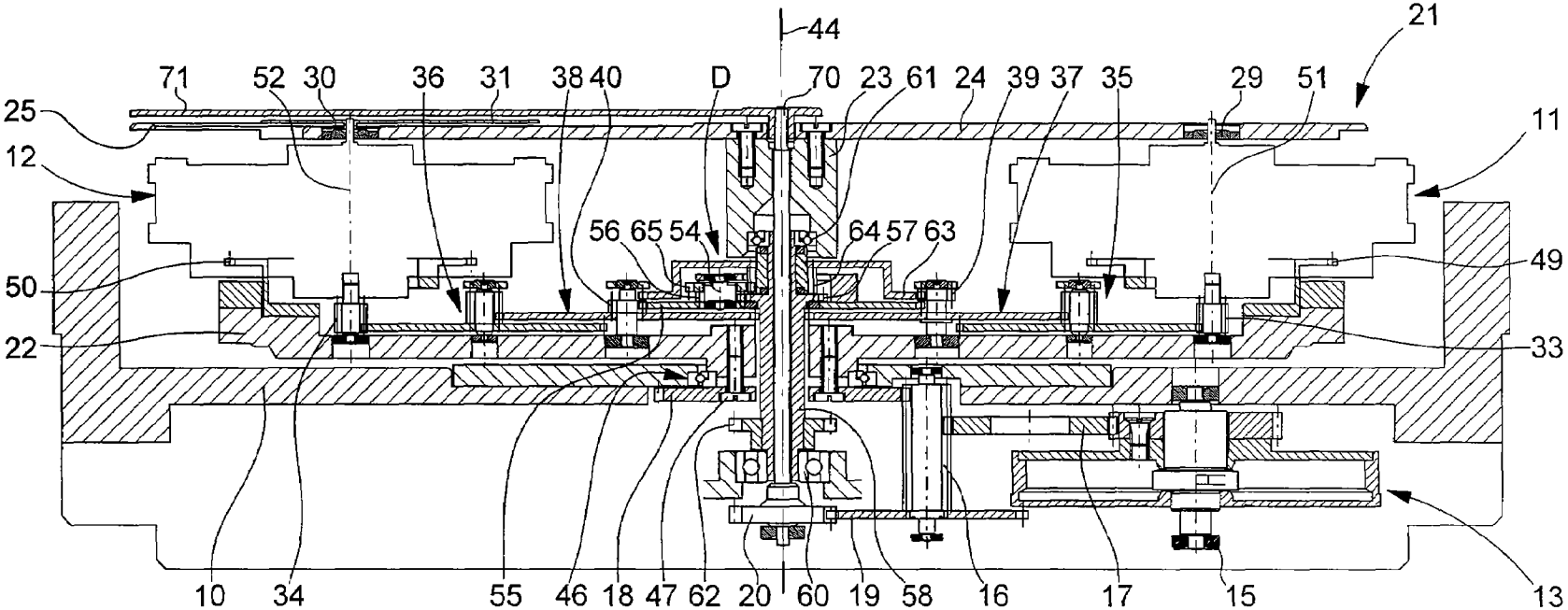
FIG. 4 is a partial cross-section of the watch movement of FIG. 3.
Figure 5:
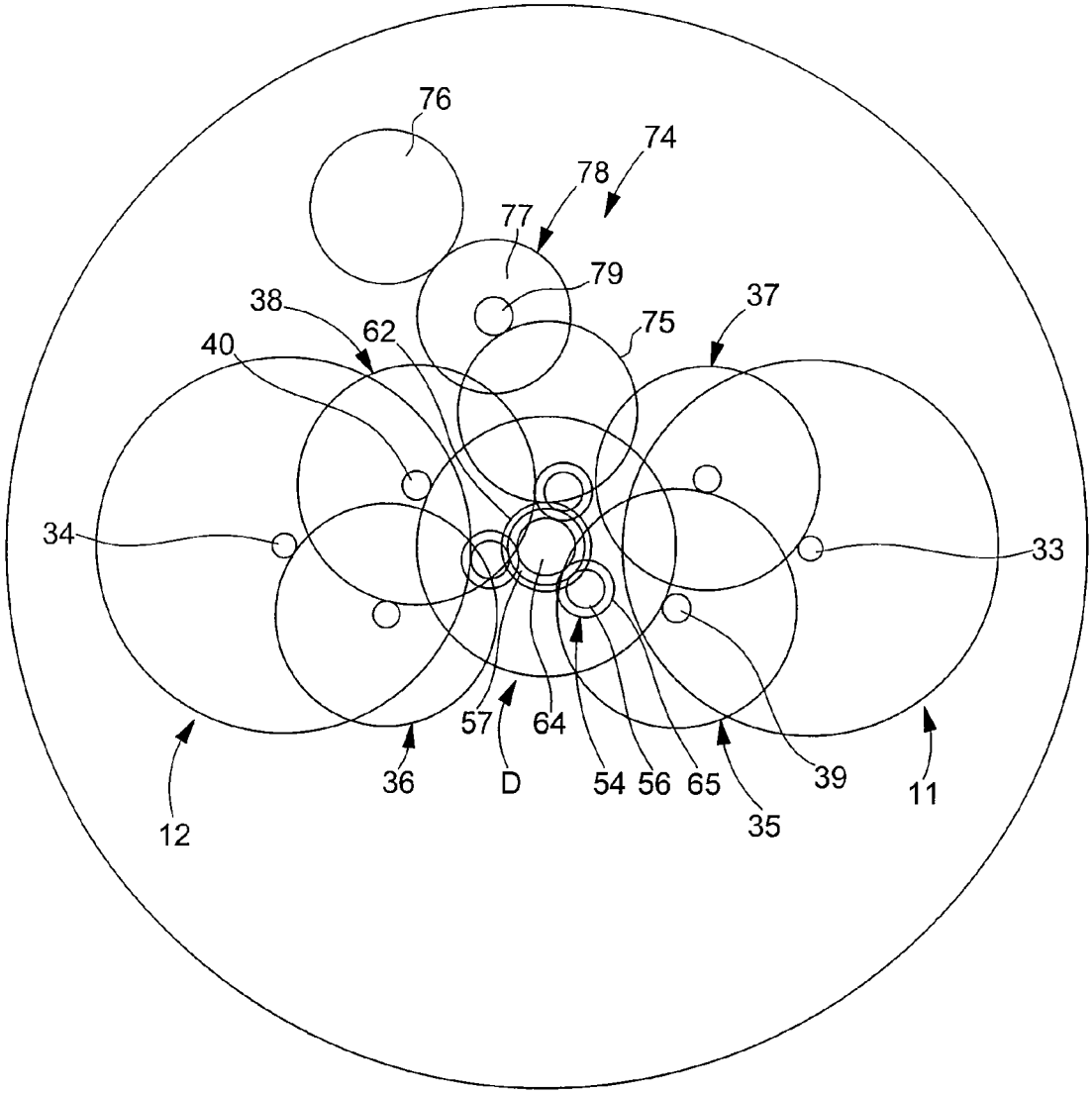
FIG. 5 is a plan view of the gear trains located above the rotating plate of the watch of FIG. 3, and a time-setting train arranged underneath the fixed plate.

FIGS. 3 to 5 show a preferred embodiment of the invention, operating in accordance with the diagram of FIG. 2 and in which differential gear D and tourbillons T1 and T2 are mounted on a rotating support. The watch movement comprises a fixed plate 10 to be mounted in a case that is not shown. In a conventional manner, the side of the watch with the time display will be designated the top. It is also on this side that the two tourbillons 11 and 12, which are identical in this example, are located.

Two spring barrels 13, only one of which is visible in FIG. 4, are mounted underneath plate 10 using a barrel bar 15 and both driving the same motion work pinion 16, each via an intermediate wheel 17. Pinion 16 is meshed with an hour wheel 18 and, as is usual, it carries a wheel 19 meshing with a minute pinion 20 in order to rotate the latter twelve times faster than hour wheel 18. The barrel winding is not shown here, but those skilled in the art will understand that they can use a gear train that meshes with the two ratchets mounted on the barrel arbours, given that the two barrels acting in parallel are always wound the same.

The two tourbillons 11 and 12 are mounted on a rotating support 21 comprising a rotating plate 22, a central bar 23 and a top bar 24 a pointed end 25 of which forms the hour hand of the watch, moving opposite an hour circle on an annular dial 26. The other end of bar 24 is provided with an annular portion bearing a seconds scale 28. The carriage of each tourbillon 11, 12 comprises a top pivot which is mounted in a bearing 29, 30 of bar 24. The pivot of the second tourbillon 12 also carries a seconds hand 31 which rotates opposite scale 28, each tourbillon completing here, as usual, one revolution per minute on rotating support 21. The latter completes one revolution in twelve hours, which means that hour hand 25 can be fixed thereto.

The bottom pivot of each tourbillon 11, 12 is mounted in rotating plate 22 by a respective unreferenced bearing and comprises a drive pinion 33, 34 secured to the carriage. This pinion plays the part of the seconds pinion of a conventional movement. Each pinion 33, 34 is meshed with a going train comprising a third wheel set 34, 36 and a centre wheel set 37, 38, whose pinion 39, 40 receives the couple for driving the respective oscillator. In order to do this, each pinion 39, 40, by moving with the rotation of rotating plate 22, rolls over a central toothed wheel of differential gear D centred on the axis of rotation 44 of plate 22.

Rotating plate 22 is supported on fixed plate 10 by a single bearing formed by a large ball bearing 46, whose inner ring is gripped between plate 22 and hour wheel 18 by screws 47. The total couple of the two barrels 13 and 14 acting on elements 16 and 18 rotates plate 22 carrying the two tourbillons 11 and 12 and their respective seconds wheels 49 and 50, which are secured to plate 22. It is the revolution of the axes of rotation 51 and 52 of the two tourbillons about the central axis 44 that causes wheel sets 35 to 38 of the two going trains to rotate by rolling them over the median element formed by the differential gear, thus causing each tourbillon to rotate about its own axis.

Differential gear D is of the epicycloid type, with for example three double planetary wheels 54 mounted on a planetary wheel carrier 55 whose external toothing meshes with pinion 40 of the going train of the second tourbillon 12. A first toothing 56 of the planetary wheel meshes with an external toothing 57 of a stationary pipe 58, which forms the usually fixed support element of the differential gear. In reality, pipe 58 can pivot about central axis 44 in order to set the time of the watch, as will be described hereinafter, and this is why it is rotatably mounted by a bottom ball bearing 60 in a fixed bar and by a top ball bearing 61 in bar 23, and it is fitted with a time-setting pinion 62 below fixed plate 10.

The third central element of differential gear D is an output wheel 63 having an external toothing that meshes on pinion 39 of the going train of the first tourbillon 11. The external diameter of wheel 63 is the same as that of planetary wheel carrier 55. Wheel 63 is rotatably mounted on pipe 58 and comprises a pinion 64, which meshes with the second toothing 65 of each planetary wheel. Toothings 56 and 65 of the planetary wheels and the corresponding toothings of elements 58 and 63 are such that elements 55 and 63 can rotate at equal but opposite speeds, when pipe 58 is immobile. But, since these two speeds are each regulated by one of tourbillons 11 and 12 and may thus differ slightly because of momentary variations in rate, the effect of differential gear D is to average these two speeds in the speed of revolution of plate 22 carrying the bearings of the going trains and the tourbillons. This is how a regularity of rate that is better than that of either of the tourbillons is obtained.

The rotation of rotating plate 22 carrying hour wheel 18 is transmitted by the motion work 16, 19 to the minutes pinion 20 fixed to an arbour 70 carrying minute hand 71 and rotatably mounted in pipe 58. Thus, the hour and minute hands 25 and 71 display the time in the usual manner on dial 26, whereas the display of the seconds by hand 31 and scale 28 completes one revolution in twelve hours about central axis 44 of the movement. Moreover, it will be noted in FIG. 3 that there is a display 72 of the power reserve on the top face of fixed plate 10. This device can be coupled to only one of the two barrels.

If one wished rotating support 21 to rotate at a different speed from one revolution in twelve hours, for example more quickly so that its movement is more visible, one could add an hour hand carried in the usual manner by a pipe surrounding minute arbour 70 and driven by a motion work.

FIG. 5 shows a time setting train 74 comprising a wheel 75 which meshes on time setting pinion 62 shown in FIG. 4. This train located underneath fixed plate 10 can be actuated in the usual manner by a control stem 73 (FIG. 3) provided with a crown on the outside of the watch. This stem actuates an intermediate wheel 76 meshing with the wheel 77 of a wheel set 78 whose pinion 79 rotates wheel 75. Wheel set 78 is immobilised on plate 10 by a friction device whose maximum couple may be relatively low, while exerting a strong holding couple on pipe 58 due to the multiplication of the couple between wheel set 78 and wheel 62.

Those skilled in the art will easily understand that one or each of tourbillons T1, T2 appearing in FIG. 2 might be a tourbillon with several axes of rotation, in particular one of the types mentioned in the introduction. Those skilled in the art will also be able to devise a movement with more than two tourbillons by applying the principles of the present invention, since a suitable differential gear can couple more than two tourbillons mounted on the rotating support, so as to average their speeds on the watch display.

Moreover, even if the two tourbillons have the same nominal frequency in the example described hereinbefore, this is not indispensable, since suitable sizing of the gear trains and/or differential gear D allows two different nominal frequencies to be properly averaged.

The invention claimed is:

1. A watch with a mechanical movement including two tourbillons, which are mounted on a common rotating support and coupled by gear trains to the same median element, the tourbillons being mounted between a rotating plate and a bar which form part of the rotating support, which is driven by a mechanical energy source and connected to an analogue time display device.

2. The watch according to claim 1, wherein the rotating support completes two revolutions per day and carries an hour hand.

3. The watch according to claim 2, wherein an hour wheel, fixed to the rotating support, drives a minute hand via a motion work on which said mechanical energy source acts.

4. The watch according to claim 2, wherein the hour hand is formed by said bar, which includes an annular portion provided with a seconds scale above one of the tourbillons, which carries a seconds hand.

5. The watch according to claim 1, wherein said median element is formed by a differential gear.

6. The watch according to claim 5, wherein the differential gear is centered on the axis of rotation of the rotating support and includes a support element which is rotatably mounted and immobilised by a friction device.

7. Watch according to claim 6, wherein said friction device is arranged in a time setting train acting on the support element, such that the friction couple produced by said device is multiplied by the time setting train to act on the support element.

8. Watch according to claim 6, further comprising a drive pinion associated with each of the tourbillons, and a wheel of the differential gear associated with each of the drive pinions, wherein each of the drive pinions is connected to the respective wheel of the differential gear by a going train.

9. Watch according to claim 1, wherein the tourbillons are two in number and are identical.

* * * * *